US008845820B2

(12) United States Patent
Geppert et al.

(10) Patent No.: US 8,845,820 B2
(45) Date of Patent: Sep. 30, 2014

(54) TUBE LANCING MACHINE

(75) Inventors: Christian Geppert, Bad Homburg (DE); Stefan Scroth, Offenbach (DE)

(73) Assignee: Aquajet Ltd., Belize (BZ)

( * ) Notice: Subject to any disclaimer, the term of this patent is extended or adjusted under 35 U.S.C. 154(b) by 165 days.

(21) Appl. No.: 13/334,804

(22) Filed: Dec. 22, 2011

(65) Prior Publication Data

US 2012/0090651 A1 Apr. 19, 2012

Related U.S. Application Data

(62) Division of application No. 12/275,333, filed on Nov. 21, 2008, now Pat. No. 8,083,865.

(51) Int. Cl.

| | |
|---|---|
| ***B08B 9/00*** | (2006.01) |
| ***B08B 9/043*** | (2006.01) |
| ***F28G 3/16*** | (2006.01) |
| ***F28G 15/04*** | (2006.01) |
| ***F28G 15/02*** | (2006.01) |

(52) U.S. Cl.

CPC ..... *B08B 9/0433* (2013.01); *F28G 3/163* (2013.01); *F28G 15/04* (2013.01); *F28G 15/02* (2013.01)

USPC ..... 134/166 C

(58) Field of Classification Search

None

See application file for complete search history.

(56) References Cited

U.S. PATENT DOCUMENTS

| | | | | |
|---|---|---|---|---|
| 3,903,912 | A | 9/1975 | Ice, Jr. et al. | |
| 4,225,362 | A | 9/1980 | Sentell | |
| 5,022,463 | A | 6/1991 | Boisture | |
| 5,299,533 | A | 4/1994 | Johnston, Jr. et al. | |
| 5,579,726 | A | 12/1996 | Finucane | |
| 6,681,839 | B1 | 1/2004 | Balzer | |
| 6,892,679 | B2 * | 5/2005 | Jameel et al. | 122/379 |
| 2004/0006841 | A1 * | 1/2004 | Jameel et al. | 15/318.1 |

OTHER PUBLICATIONS

Web page regarding Lancing Systems from StoneAge Waterblast Tools.

* cited by examiner

*Primary Examiner* — Jason Ko

(57) ABSTRACT

A pair of parallel metal lances is driven by a transversal drive into and out of heat exchanger tubes. The lances are supported by a plurality of spaced apart, retractable door supports so that the transversal drive mechanism can approach the tube sheet of the heat exchanger tubes as closely as possible. A pair of rotational drive motors rotates the lances at a user controllable speed. As the lances are moved into the tubes, the interlocked support doors retract one at a time, sequentially. Similarly, as the lances are withdrawn from the tubes, the support doors close one at a time in an interlocked fashion.

3 Claims, 11 Drawing Sheets

FIG.11
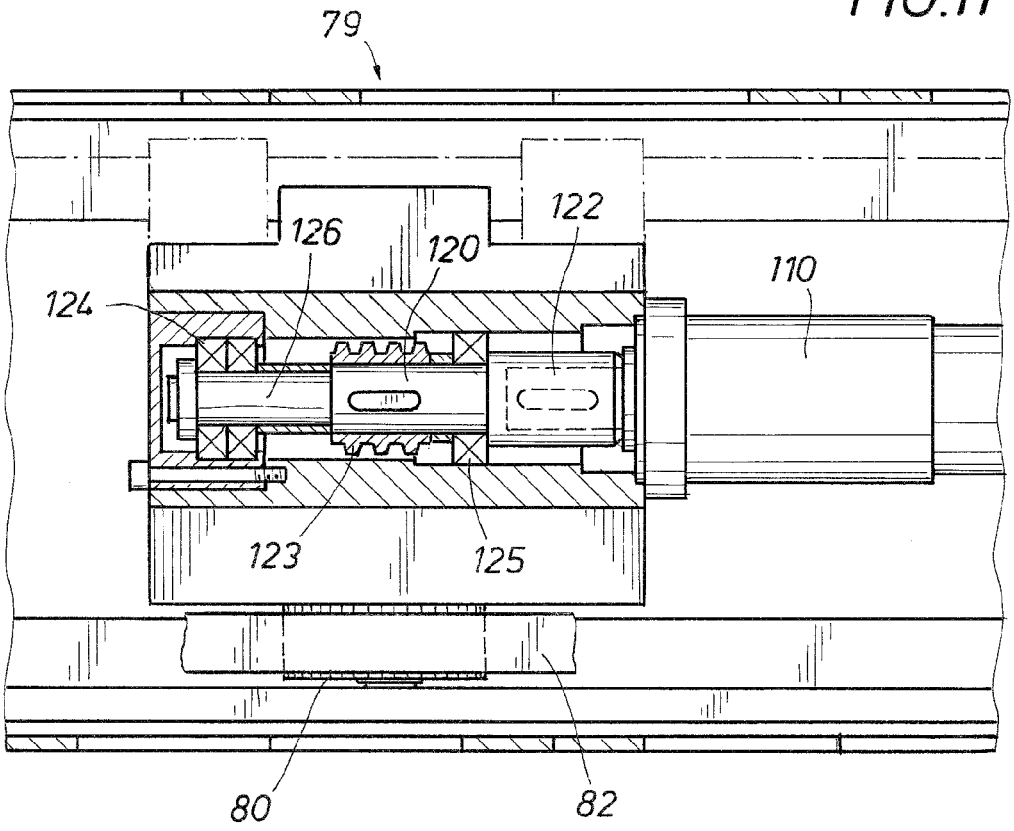
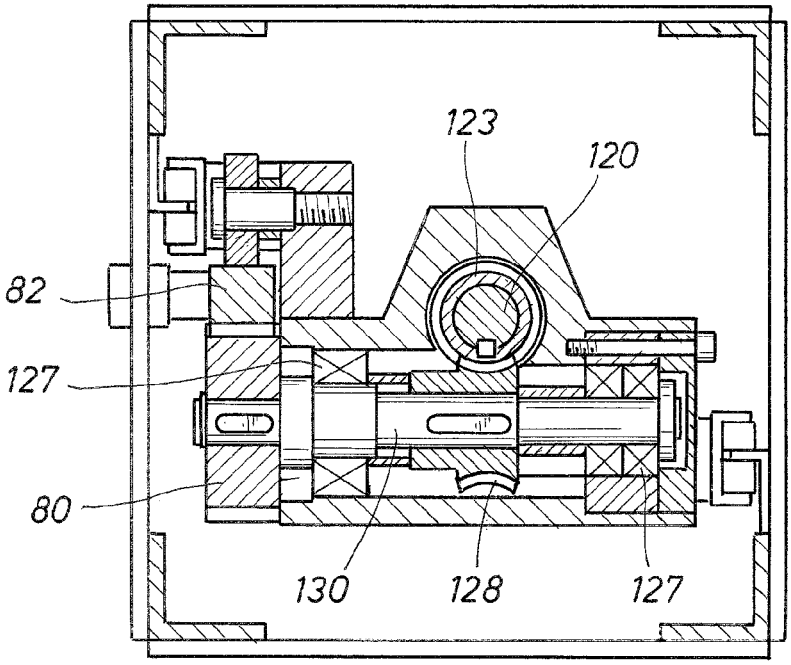
FIG.12

FIG. 13
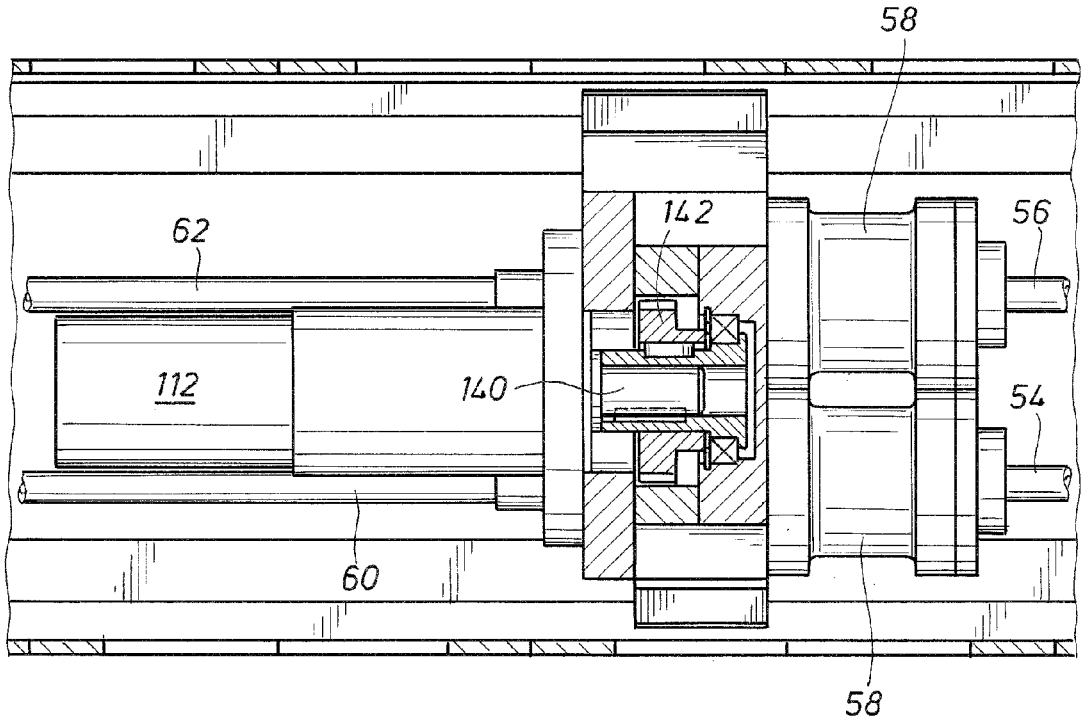
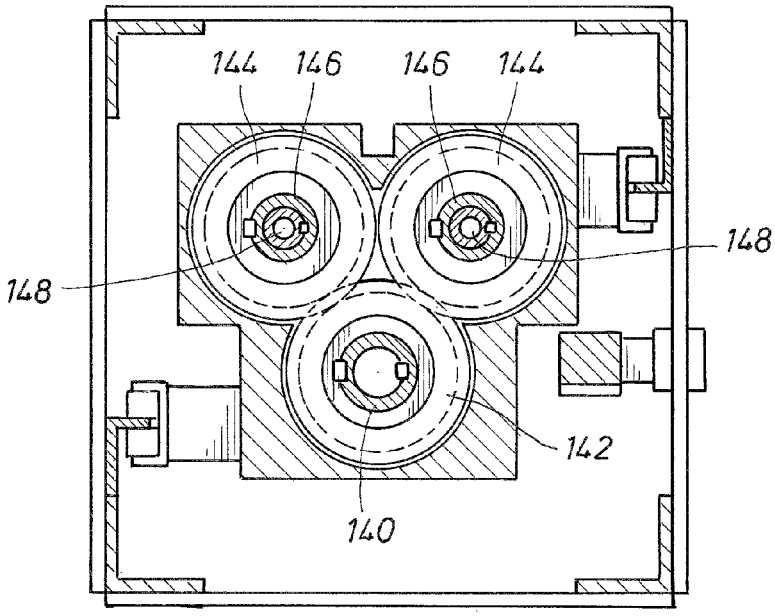
FIG. 15

TUBE LANCING MACHINE

This is a divisional application of co-pending U.S. patent application Ser. No. 12/275,333 filed Nov. 21, 2008.

FIELD OF THE INVENTION

The present invention relates generally to the field of apparatus for cleaning the inside of tubes in straight-tube type heat exchangers and, more particularly, to a twin, rigid lance machine which maximizes the stroke of the lance.

BACKGROUND OF THE INVENTION

Heat exchangers are used extensively in manufacturing plants for various applications. For example, as described in U.S. Pat. No. 6,681,839 to Balzer, heat exchangers may be used to maintain process control over various manufacturing processes such as in the production of plastics and other chemicals. These heat exchangers include exchange-tubes through which the manufactured chemicals must flow that often become narrowed by the accumulation of the chemicals on the inner walls of the exchange-tubes. This narrowing causes inefficient heat exchange and can reduce plant production.

To alleviate this narrowing build up, a work crew must typically partially disassemble the plant in order to move the heat exchanger to a location where another work crew can then manually position a high pressure cleaning lance through each of the exchange-tubes to remove the narrowing build up. Cleaning the exchange-tubes manually with a high pressure cleaning lance is dangerous to the workers because the cleaning lance generates high pressure jets of water that can injure a worker. Also, the narrowing buildup removed by the high pressure jets can include dangerous chemicals that can poison and/or chemically burn the skin, lungs, eyes and other body parts of the workers on the work crew. In addition, manual cleaning of the exchange-tubes with a high pressure cleaning lance is slow, physically exhausting and expensive to perform.

An example of a rigid lance machine is available from Stoneage, Inc. of Durango, Colo. The Stoneage lance machine includes a pair of parallel slide rails that guide a plurality of polymeric guide supports. The rigid lance, of roughly a quarter inch diameter, rides through a hole in the guide supports, each of which is about an inch thick. The lance is coupled to a prime mover, which rotates the lance at a high speed as the lance is fed into an exchange-tube of a heat exchanger. As the prime mover is moved forward in order to advance the lance into the tube, each sequential guide support comes into abutting contact with the guide support in front of it. Thus, the guide supports stack up as the lance moves into the tube. For this reason, the machine is limited in the number of guide supports that can be used, yet the guide supports must be close enough together to prevent the lance from buckling as it rotates. This severely limits the machine because if, for example, fifty such guide supports are mounted on the machine, then the prime mover can get no closer than 50 inches away from the entry into the tube bundle.

Thus, there remains a need for heat exchanger tube lancing machine that is not so limited, allowing the prime mover to move as close as possible to the entry into the tube bundle, while still providing superior cleaning capability of the lancing machine. The present invention is directed solving these and other needs in the art.

SUMMARY OF THE INVENTION

In order to achieve these and other improvements to known lancing machines, a pair of parallel metal lances is driven by a transversal drive into and out of heat exchanger tubes. The lances are supported by a plurality of spaced apart, retractable door supports so that the transversal drive mechanism can approach the tube sheet of the heat exchanger tubes as closely as possible. A pair of rotational drive motors rotates the lances at a user controllable speed. As the lances are moved into the tubes, the interlocked support doors retract one at a time, sequentially, to prevent uncontrolled transverse movement of the transversal drive. Similarly, as the lances are withdrawn from the tubes, the support doors close one at a time in an interlocked fashion.

These and other features and advantages of this invention will be readily apparent to those skilled in the art.

BRIEF DESCRIPTION OF THE DRAWINGS

So that the manner in which the above recited features, advantages and objects of the present invention are attained and can be understood in detail, more particular description of the invention, briefly summarized above, may be had by reference to embodiments thereof which are illustrated in the appended drawings.

FIG. 11 is a detail view in partial section of the transversal drive mechanism as seen along section lines 11-11 of FIG. 9.

FIG. 12 is a section view of the transversal drive mechanism as seen along section lines 12-12 of FIG. 9.

FIG. 13 is a detail view in partial section of the rotational drive mechanism as seen along section lines 13-13 of FIG. 9.

FIG. 15 is a detail view in partial section of the rotational drive mechanism as seen along section lines 15-15 of FIG. 9.

DETAILED DESCRIPTION OF PREFERRED EMBODIMENTS

Figure 1:
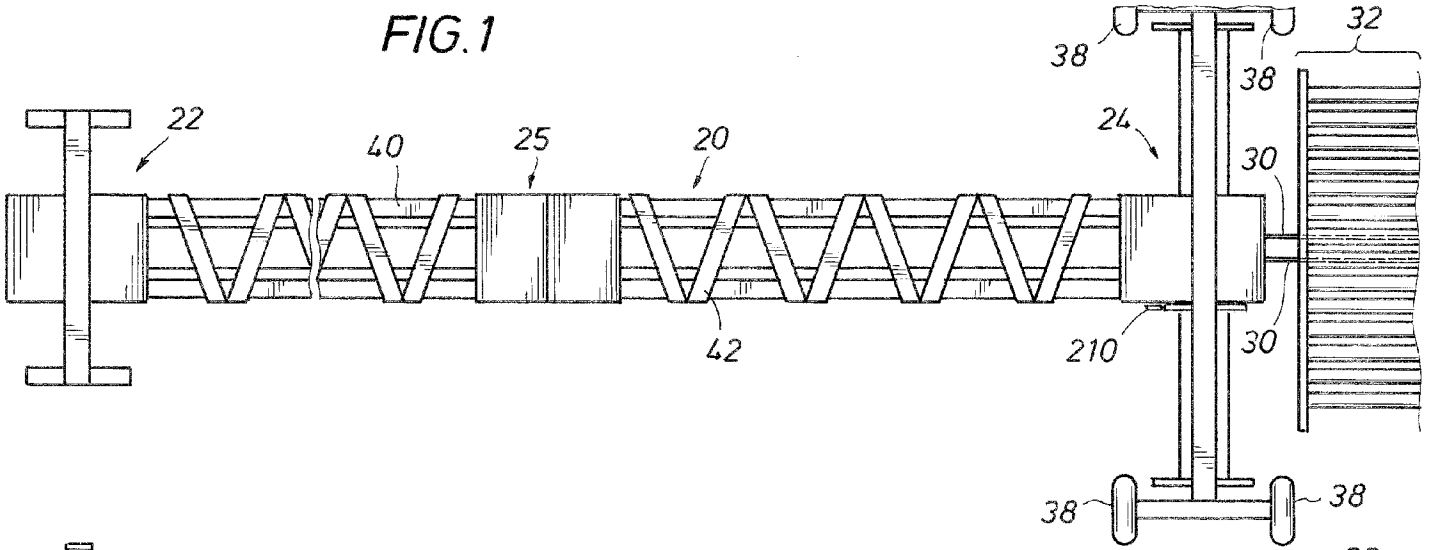
FIG. 1 is a top-down view of a lancing machine in accordance with this invention, depicting a guideway in position for a cleaning operation.
Figure 2:
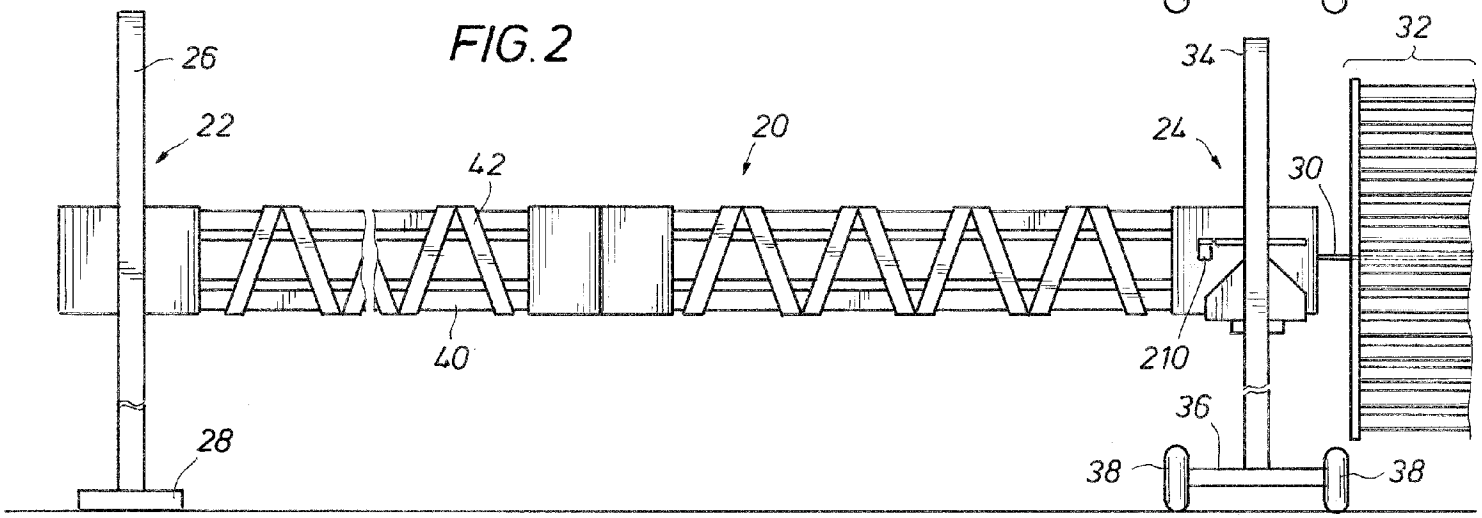
FIG. 2 is a side, elevation view of the lancing machine of FIG. 1.

FIGS. 1 and 2 depict a tube lancing machine 20 constructed in accordance with the teachings of the present invention.

FIG. 1 illustrates the machine 20 as seen from above, and FIG. 2 shows the machine from the side. The machine includes an after support 22 and a forward support 24, with a guideway 25 supported between the after and forward supports 22 and 24. It should be noted that the lancing machine may be used in any orientation, including horizontal or vertical or any orientation therebetween and thus the "forward" or "first" support refers to the support closest to the tubes which are to be lanced, and the "after" or "second" support refers to the support farthest from the tubes. The after support 22 is illustrated as including a stanchion 26 which is supported by a pedestal 28 for illustration purposes, although any appropriate structure to support the after end of the guideway 25 may be used. The guideway retains other structure, as described in detail below, to present a pair of lances 30 into a pair of tubes within a tube bundle 32. The forward support 24 is illustrated as including a vertical member 34 which is supported by a chassis 36, which includes a plurality of wheels 38.

The guideway 25 preferably comprises an open frame structure, with a plurality of axially oriented elongate members 40 held by a number of angle brackets 42 to provide structural rigidity, while saving substantial weight for the machine. The guideway is extendable, in that the guideway may be formed of sections which simply attach to one another and no alteration is the drive mechanism supported by the guideway is required. The weight of the machine may be a major consideration in certain applications, particularly where the entire machine must be oriented at a position other than strictly horizontal. In summary, the machine comprises the supports 22 and 24, supporting the guideway 25, which holds apparatus to drive the lances 30 and supply cleaning fluid to them, shown and described in respect of FIGS. 3 and 4. It should be noted that, while the structure is illustrated with the machine oriented horizontally, the machine may actually be operated in horizontal or vertical setup. For a vertical setup, the support 24 would be held in place by a scaffold and positioned more towards the center of gravity of the lancing machine 20, and an after support may or may not be used for such a vertical application.

Figure 3:
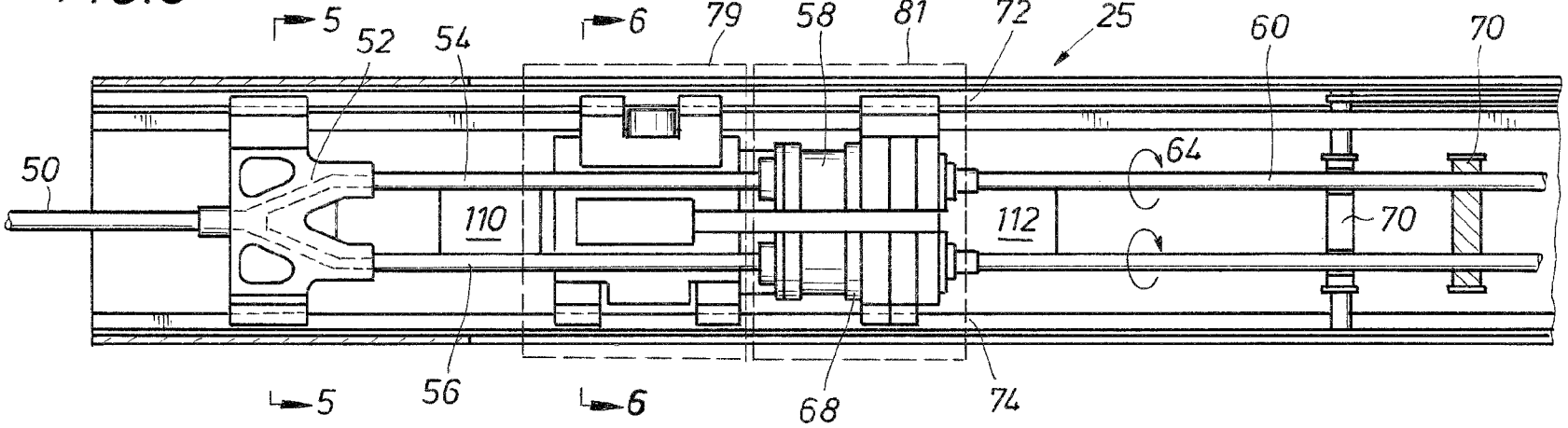
FIG. 3 is a detail view of the cleaning fluid supply and lance drive system of the lancing machine.
Figure 4:
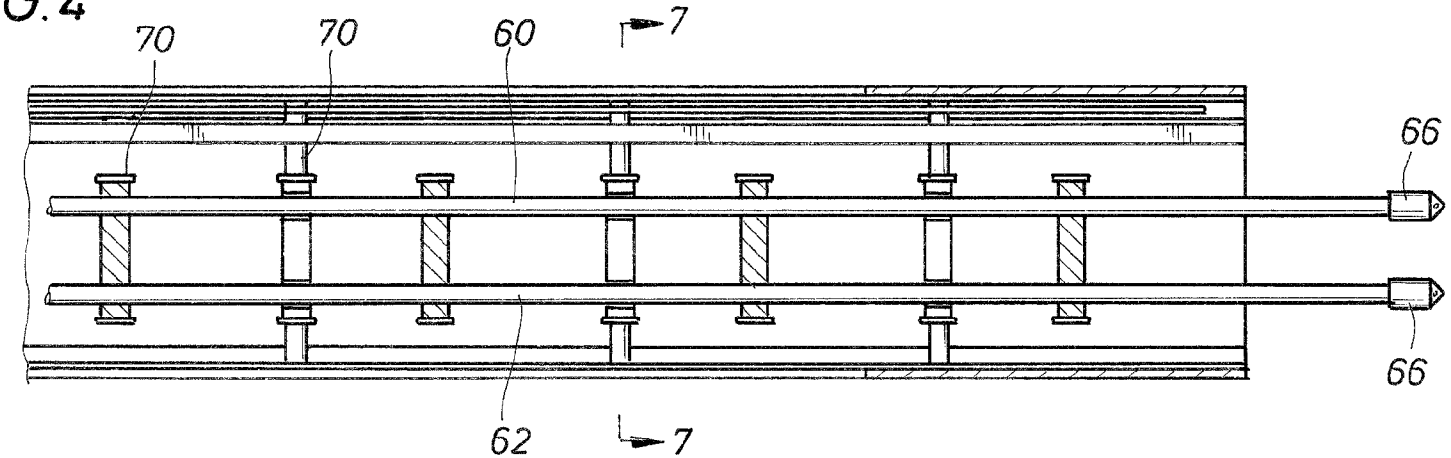
FIG. 4 is a detail view of the lancing machine, extending from the right hand end of FIG. 3.

FIGS. 3 and 4 illustrate this drive and supply structure, with FIG. 4 continuing the structure to the right of FIG. 3. A cleaning fluid supply line 50 enters the guideway 25 at the left as seen in FIG. 3, supplying high pressure cleaning fluid, preferably water, to the machine. The supply line 50 splits at a bifurcation bracket 52 to supply cleaning fluid to a port side supply line 54 and a starboard supply line 56. The port and starboard supply lines 54 and 56 terminate at a dual swivel 58. The swivel 58 conducts the cleaning fluid into the interior of a hollow port side lance 60 and similarly into a hollow starboard side lance 62. The swivel 58 with a high pressure rotary seal allows the rotation of the lances as shown by the arrows 64. The rotational drive is driven by a pneumatic motor 112.

The rotating lances 60 and 62 are driven by a rotational drive 81 and terminate in rotating cleaning heads 66, which in operation of the lancing machine are inserted into and travel through sequential tubes within the tube bundle 32. Between the swivel and the cleaning heads, the lances 60 and 62 pass through a plurality of retractable doors 70. In the Stoneage lancing machine, described in the Background of the Invention, above, plurality of polymeric supports, each with a hole therethrough, retains and supports the lance and, as the drive mechanism advances the lance into the tube, the polymeric supports slide forward. Each comes into abutting contact with the one in front of it, and the supports then stack up between the drive mechanism and the tube bundle, thereby limiting how close to the tube bundle the drive mechanism can reach. In contrast, in the present invention, the retractable doors 70 retract out of the way of the drive mechanism, so that drive mechanism can advance right up to the tube bundle. Operation of the retractable doors 70 will be described below in greater detail.

Figure 5:
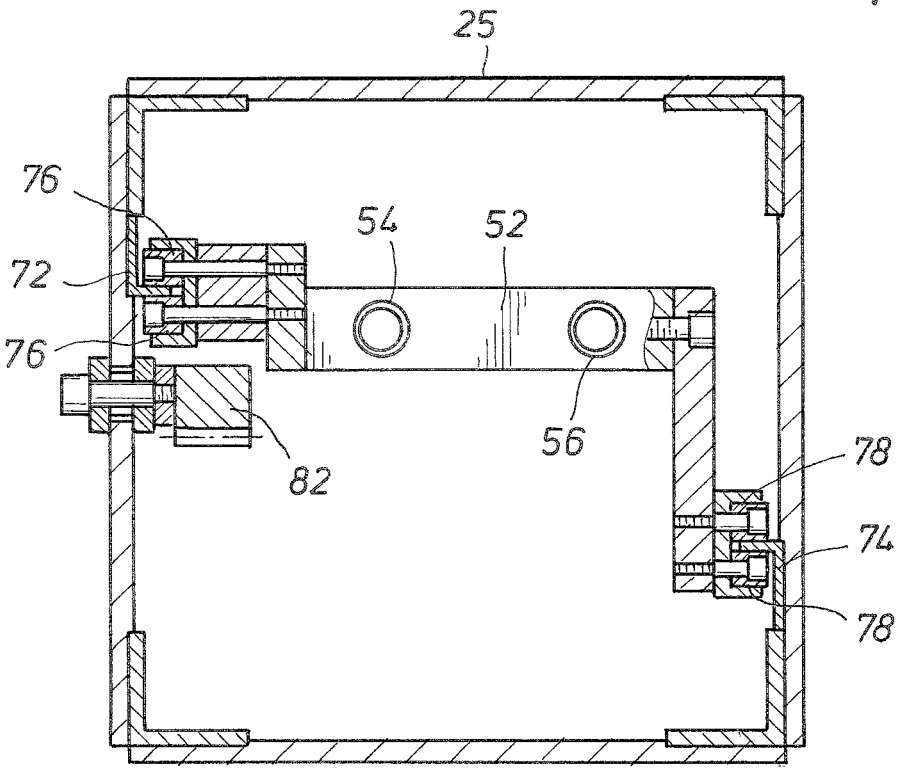
FIG. 5 is a section view of the machine, taken along section lines 5-5 of FIG. 3.

As previously described, the supply line 50 splits at a bifurcation bracket 52 into two supply lines, and during operation of the machine the bracket 52 moves forward toward the tube bundle along with the rest of the drive mechanism. As section view of the bracket 52 is shown in FIG. 5. The bracket 52 includes the port side supply line 54 and the starboard supply line 56, looking toward the forward end of the machine. The bracket is supported on the port side by an L-bracket 72 and on the starboard side by an L-bracket 74. A pair of elastomeric, preferably plastic bearings 76 ride above and below the L-bracket 72, to support the bracket and minimize friction. A similar pair of elastomeric or plastic bearings 78 ride above and below the L-bracket 74 on the starboard side.

Figure 6:
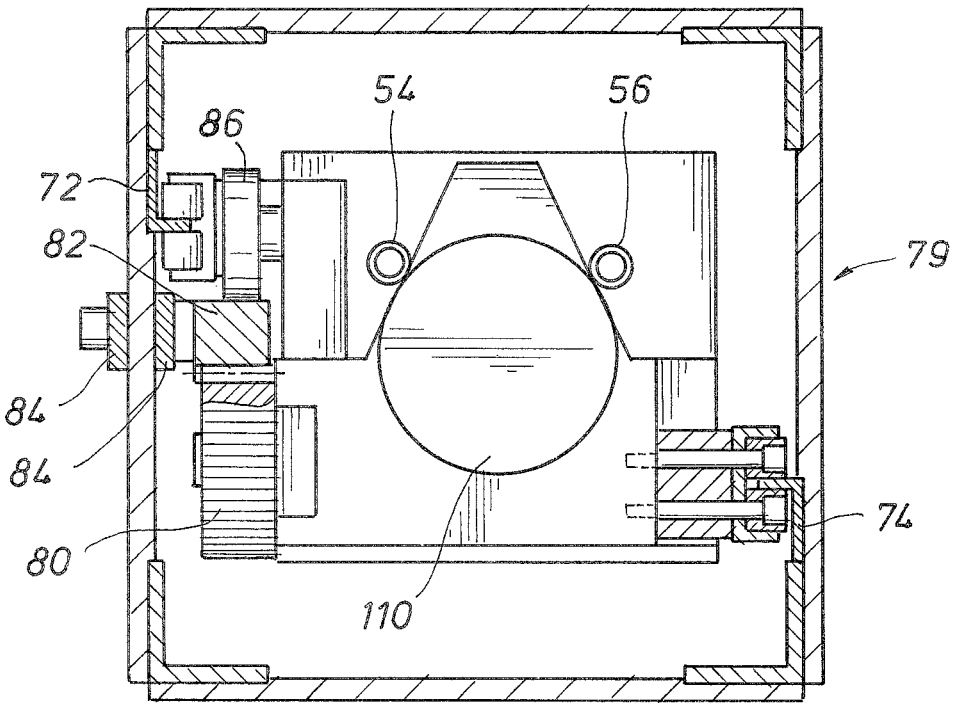
FIG. 6 is a section view of the machine, taken along section lines 6-6 of FIG. 3, illustrating a transversal drive mechanism.

Referring now to FIGS. 5 and 6 together, a translational force is required to move the lances into and withdraw the lances from the exchange-tubes, which is provided by a transversal drive 79 (see FIG. 3). The interface between the translational force provided by the transversal drive 79 and the guideway 25 includes a pinion gear which meshes with gear teeth on the underside of a rack 82. The rack 82 is secured to the port side of the guideway 25 with mounting nuts 84. Since the machine for lancing tubes operates in a harsh environment, including extreme vibration, an idler bearing 86 rides along the top surface of the rack, thus ensuring that the gears of the rack 82 and the pinion gear 80 remain engaged. The rack 82 is floatingly attached to guideway 25 with the floating bearing 84. The idler bearing 86 in combination with the pinion gear 80 position the rack 82 in such a fashion that no stress is generated on the linear bearings 76 and 78. The pinion gear is driven by a transversal pneumatic motor 110 through an angle gear (not shown) in the conventional manner.

As previously described, one of the advantages of the machine described herein is the ability of the transversal drive and swivel mechanism to get as close as possible to the tube bundle 32. This advantage is provided by a set of retractable and interlocked doors, shown in FIGS. 7 and 8, which are views of the machine as taken along sight lines 7-7 of FIG. 4.

Figure 7:
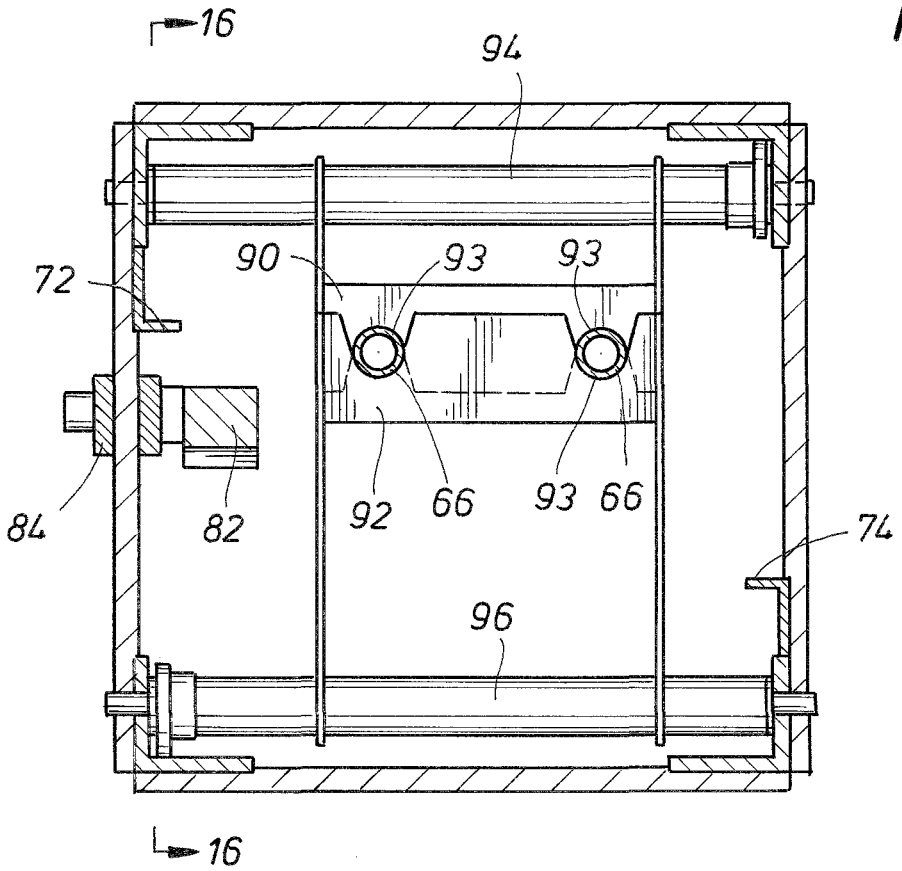
FIG. 7 is a section view of the machine, taken along section lines 7-7 of FIG. 4, illustrating retractable doors extended across the guideway.
Figure 8:
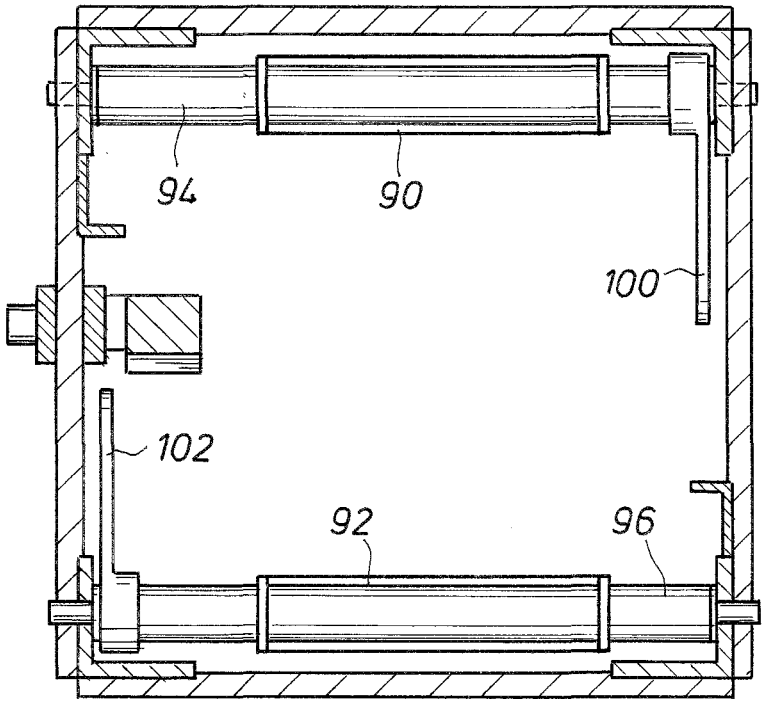
FIG. 8 is a section view of the machine, taken along section lines 7-7 of FIG. 4 illustrating the doors of FIG. 7 retracted out of the way of the drive mechanism.

FIG. 7 illustrates a pair of retractable doors, numbered 90 and 92. Note, as shown in FIG. 8, that the doors 90 and 92 are spaced apart laterally along the guideway. The door 90 is mounted on an axle 94 for rotational movement, so that the door 90 will rotate out of the way of the transversal drive 79 and the rotational drive 81 as they are moved toward the tube bundle. Note also that each door defines a pair of open, circular support grooves 93 which only address the lance on one side, in contrast to known lancing systems in which the lance penetrates a hole which completely surrounds the lance. Similarly, the door 92 is mounted on an axle 96 for rotational movement. As the transversal drive 79 and the rotational drive 81 move toward the tube bundle, the door 90 opens before door 92. As the drive unit continues to more forward, the door 92 opens next. Each of the doors opens sequentially, and the door are interlocked. Door 92 is mechanically prevented from opening until door 90 is opened.

Referring now particularly to FIG. 8, the doors 90 and 92 are illustrated in an open position. In this position, the doors have been rotated toward the tube bundle (i.e. down from the plain of FIG. 8). This position of the doors permits the advancing and rotating mechanism to advance in the direction of the tube bundle, but only as far as the next, closed door, i.e. one "span". A closing or actuator arm 100 is mounted on the axle 94 and a closing or actuator arm 102 is mounted on the axle 96. As the transversal drive is withdrawn away from the tube bundle, i.e. backwards through the guideway, a traveling ram 184 (shown and described below in respect of FIG. 16) comes into abutting contact with the actuator arm 102 first, thereby sequentially shutting the doors as the transversal drive is withdrawn. Thus, as the drive unit moves toward the tubes, the doors are opened sequentially, providing support for the lances, and conversely as the drive unit with drawn, the doors shut one at a time, thereby providing the maximum support for the lances which allowing the drive unit to approach the tube sheet as close as possible.

Figure 9:
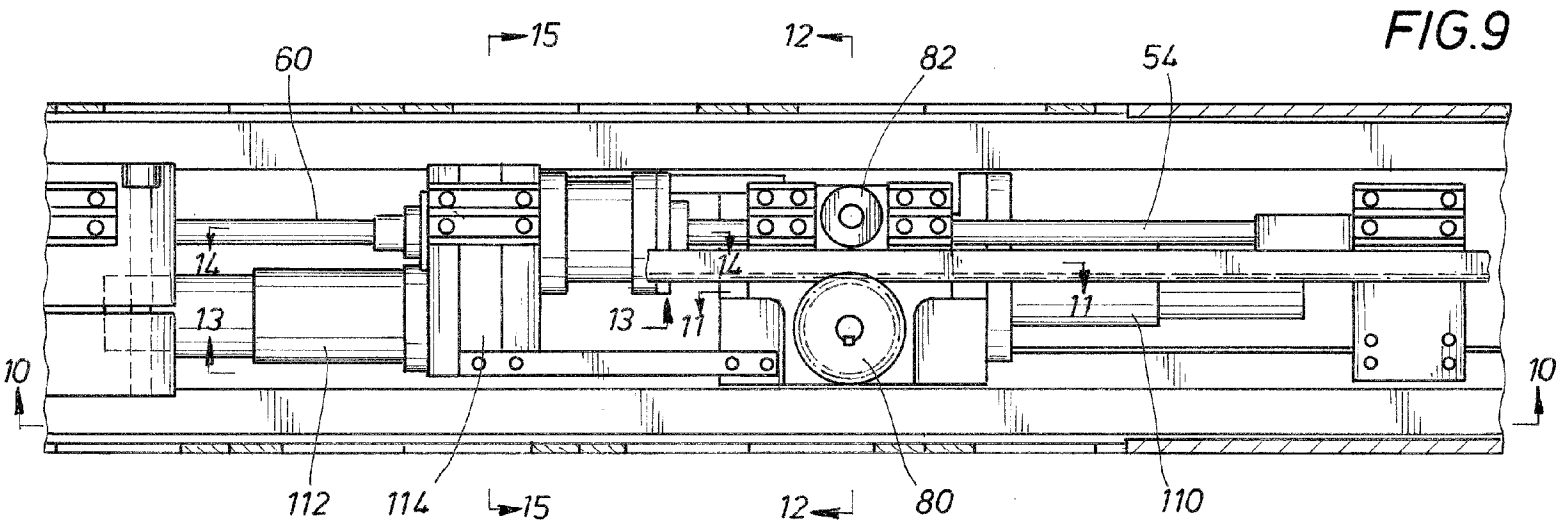
FIG. 9 is a detail, side view of the drive mechanism of the lancing machine.
Figure 10:
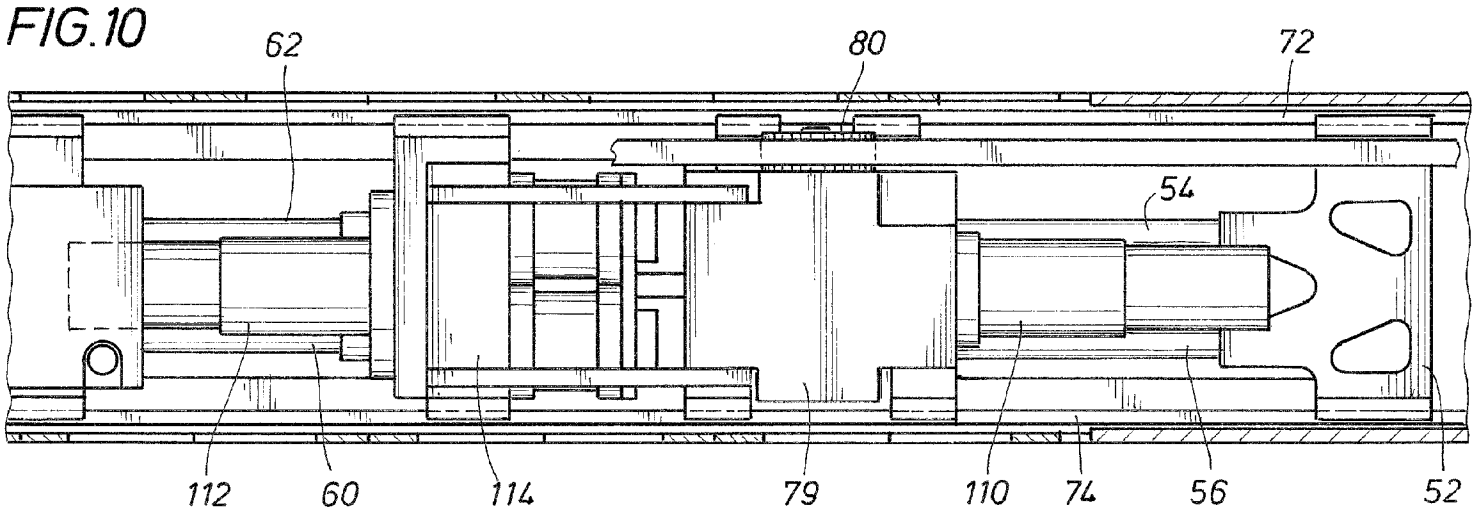
FIG. 10 is a bottom view of the drive mechanism, as seen along sight lines 10-10 of FIG. 9.

FIGS. 9 and 10 together depict further details of the transversal and rotating drive mechanisms of this invention, as seen from the side and underside of the mechanism. It should be noted that FIGS. 9 and 10 are reversed from the previous drawing figures, in that the tube bundle will be positioned at the left of the figure.

The bifurcation bracket 52 supports the cleaning fluid feed tube 50 (FIG. 3) and is supported along the L-brackets 72 and 74. The port side supply line 54 and the starboard supply line 56 join the bracket 52 to the rotational drive 114. Transverse motion of the mechanism, i.e. toward and away from the tube bundle, is provided by the transversal drive 79 powered by a pneumatic motor 110, controlled from outside the mechanism by a user-controllable, variable air pressure (not shown) in the conventional manner. The pneumatic motor 110 drives the pinion gear 80 (see also FIG. 6) to move the mechanism back and forth along the rack 82. The pinion gear 80 and the rack 82 are held in gear contact by the idler bearing 86, as previously described.

Rotation of the lances 60 and 62 is provided by a pneumatic motor 112. The pneumatic motor is coupled to the lances through a rotational drive 114.

FIG. 11 is a top down view in partial section of the transversal drive 79, as seen along sight lines 11-11 of FIG. 9, and FIG. 12 is an elevation view of the transversal drive as seen along sight lines 12-12. The motor 110 is coupled to the after end of the transversal drive at a coupling 122 which extends to an input shaft 120. The input shaft carries a worm 123, which engages a worm gear 128. The worm gear drives an output shaft 130, which is in turn coupled to the pinion gear 80, which is engaged to the rack 82. The shaft 130 is supported on bearings 127 at either end. Returning to FIG. 11, the input shaft 122 includes an extension 126 which is mounted to a bearing 124. Similarly, a bearing 125 supports the other end of the shaft.

Figure 14:
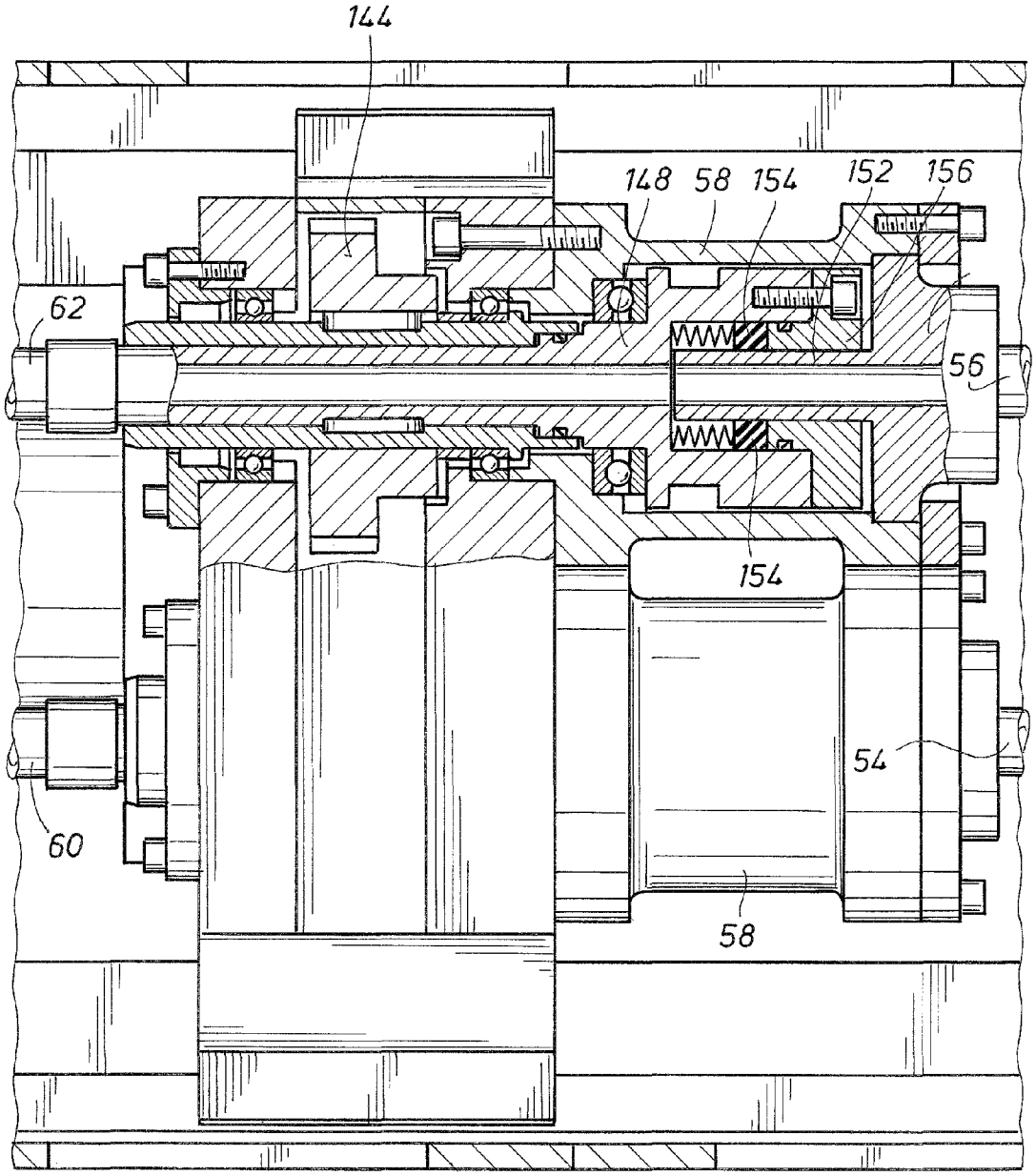
FIG. 14 is a detail view in partial section of the rotational drive mechanism and the high pressure water swivel connection as seen along section lines 14-14 of FIG. 9.

FIGS. 13, 14, and 15 provide additional details of the structure of the rotational drive of this lancing machine. The pneumatic motor 112 is coupled to the rotational drive at an input shaft 140. A pinion 142 is mounted and keyed to the input shaft and the pinion engages a pairs of wheels 144. The wheels are mounted and keyed to a pair of output shafts 146, which in turn are mounted and keyed to the high pressure water ducts 148. Thus, as the motor 112 turns, the high pressure water ducts 148 turn at a rate that is a direct function of the rate of speed of the motor 112. The lances 60 and 62 are connected to the high pressure water duct 148 in the conventional manner.

As previously described, the port side supply line 54 and the starboard supply line 56 do not rotate, but feed into the dual swivel 58. The dual swivel provides the seal means so that the cleaning fluid passes into a pair of high pressure rotating water ducts 148, which feeds the cleaning fluid to the lances. This is shown in greater detail in FIG. 14, where only the starboard side is shown in detail. It is to be understood that the port side is arranged the same way.

The starboard supply line 56 enters the dual swivel 58 at a high pressure stationary water duct 150. One advantage of the swivel 58 is that the structure provides a substantially constant diameter for the flow of cleaning fluid to minimize flow resistance. The duct 150 provides an extension 152 which provides a location for a high pressure water seal 154. The seal 154 rides at high speed around the extension 152 and is positioned within a flanged member 156. The member 156 is secured, such as for example by bolting, to the high pressure rotating water duct 148. At the exit of the rotational drive, the water duct 148 leads the cleaning fluid into the lance 62, in this case the lance of the starboard side. Also, the rotary motion for the rotating portion of the rotational drive is provided by the wheel 144, as described above in respect of FIG. 15.

Figure 16:
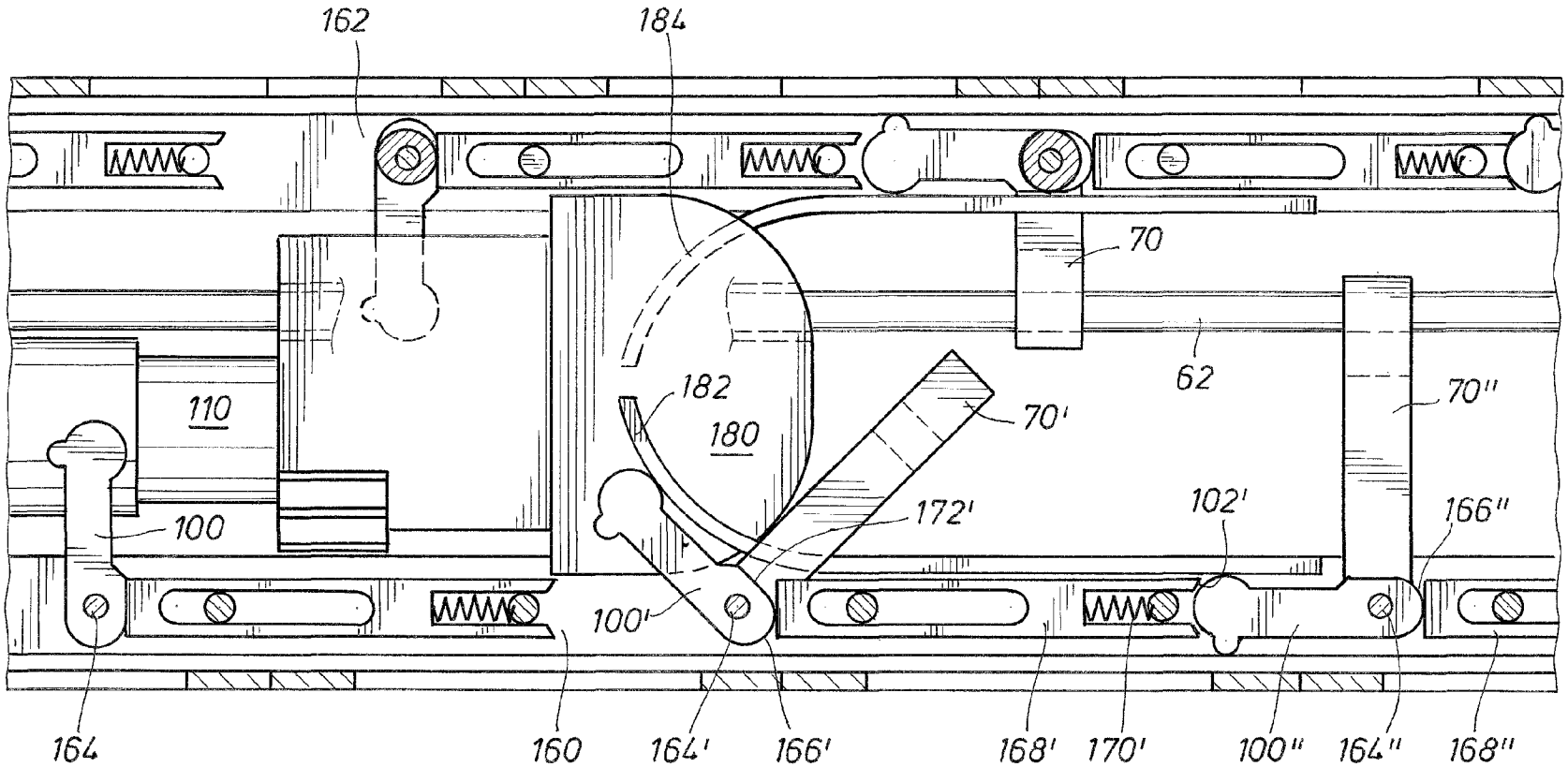
FIG. 16 is an elevation view of a set of interlocking access doors in accordance with the teachings of the present invention.

FIG. 16 illustrates another feature of the lancing machine disclosed herein, as seen in a side view. The feature includes the plurality of interlocked doors 70, individually operable as the transversal mechanism is driven to the right or to the left by the motor 110. For each door, the actuator arm 100 is affixed to the door for common movement therewith. Please note that some of the doors are mounted to a bottom support member 160 and some of the doors are mounted to a top support member 162, and that the doors are staggered with one door mounted to the bottom member followed by another door mounted to the top member, etc.

Each actuator arm 100 is mounted to a pivot 164 so that the portion of the actuator 100 around the pivot 164 acts as a cam. For example, for the actuator arm labeled in FIG. 16 as 100', a circular portion 166' holds a sliding lock 168' to the right against spring pressure of a spring 170', thereby preventing the next door 70" to the right of door 170' from retracting. As the door 70' continues to retract (rotate in a clockwise direction), a flat 172' comes into contact with the sliding lock 168', permitting the sliding lock to move to the left. This movement draws a contact latch 102' away from the actuator arm 100", allowing the subsequent retraction of the door 70"

To ensure positive opening and shutting control for the doors, a sledding arm holder 180 contacts each door in turn to open each door. As the mechanism moves to the right, the sledding arm holder 180 comes into abutting contact with the door to retract it. Then, as the mechanism is moved to the left, a pair of sledding arms 182 and 184 sequentially come into abutting contact with the actuator arms 100 to shut the doors one at a time. This feature prevents the controlled movement of the lances into or out of the heat exchanger tubes.

Another advantage of the lancing machine described herein is the use of a rigid lance. This permits the use of drilling heads on the ends of the lances so that, in the event that a tube is blocked to the extents that a water jet lance cannot clear the blockage, the rigid lance can be forced into the tube and the drilling head can bore through the blockage. This is not possible with the more common flexible lance. However, the operator should be alerted whenever resistance to forward motion is encountered. Such an alert is provided by the alternative systems of FIGS. 17 and 18.

Figure 17:
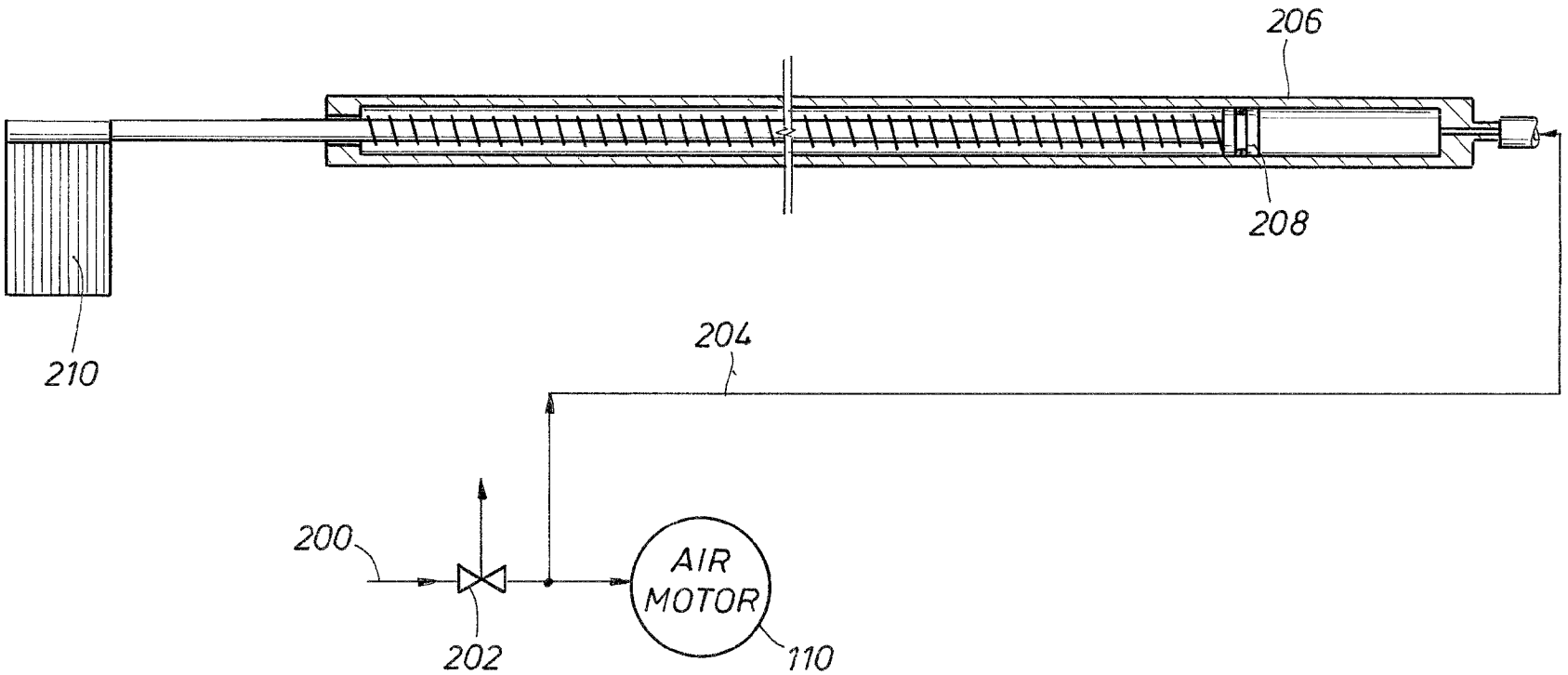
FIG. 17 is a schematic view of a pressure gauge to help an operator with the operation of the machine.

In FIG. 17, an air supply line 200 to the motor 110 is controlled by a operator at a control valve 202. Between the control valve 202 and the motor 110 is a sense line 204, which is coupled to a cylinder 206. A piston 208 within the cylinder 206 responds to air pressure in the sense line to move a flag 210 (see also FIGS. 1 and 2). Thus, as the lances are moved into heat exchanger tubes, if an obstruction is encountered, the air motor will encounter greater resistance, which will be evidenced by an increase in the pressure in the sense line 204 as a back pressure, thereby raising the flag 210.

Figure 18:
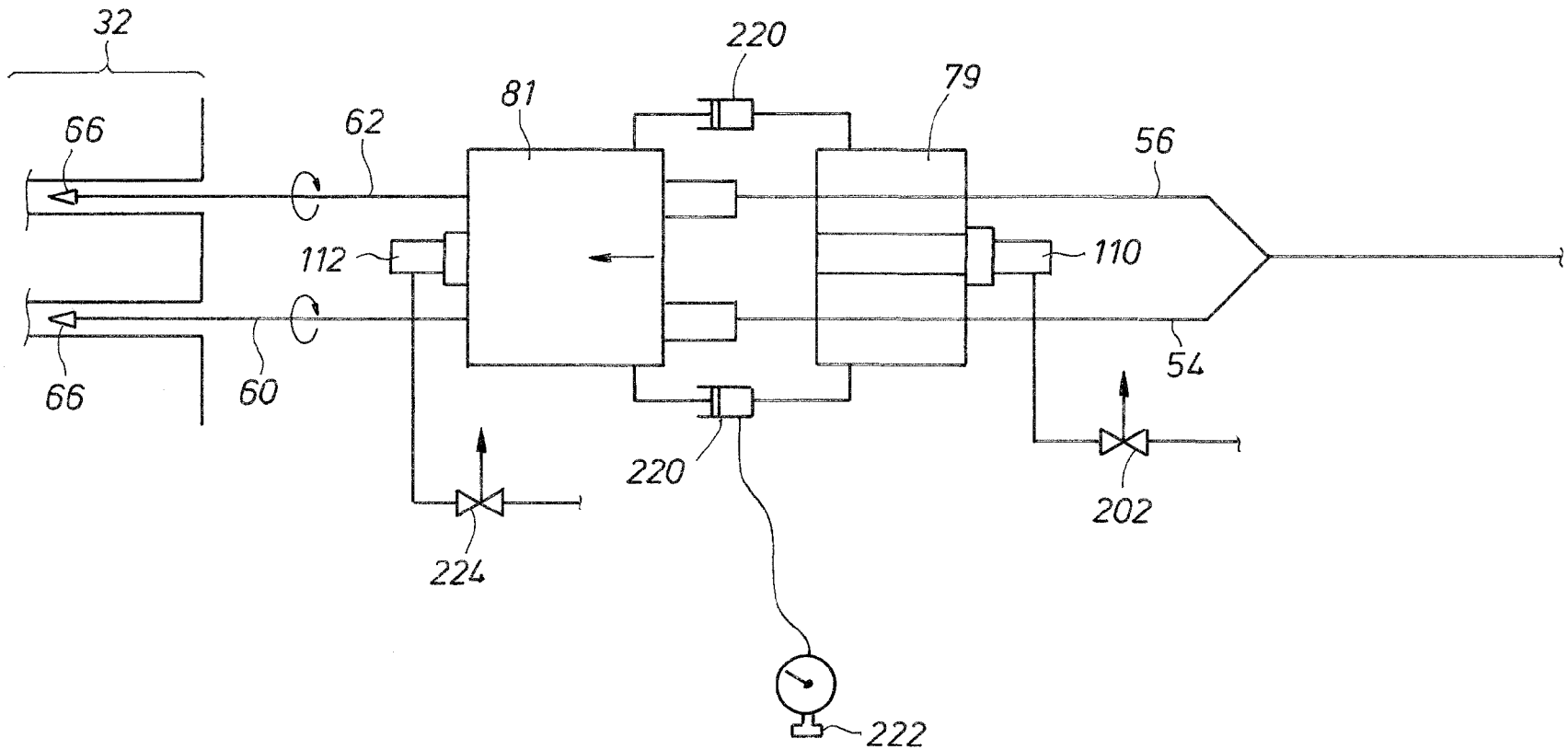
FIG. 18 is a schematic of an alternative embodiment of a system for use by an operator to indicate an obstruction in operation of the machine.

The structure of FIG. 17 has the advantage of simplicity and low cost, but lacks great sensitivity. A more complex, but a more sensitive solution, is shown in FIG. 18. In this embodiment, the transversal drive 79 and the rotational drive 81 are coupled together by at least one gas spring 220, and preferably two such gas springs. As the transversal drive moves the apparatus into the tube bundle 32, a steady state pressure is defined within the gas springs. However, if an obstruction is encountered, the pressure within the gas springs increases, which is sensed by a gauge 222, providing a visual indication to an operator. It should also be noted that, in addition to the user controllable valve 202 to control the rate of motion into and out of the tube bundle, a control valve 224 is provided to control the rate of rotation of the lances.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

We claim:

1. A lancing machine for cleaning the inside surface of one or more tubes, the machine comprising:

a. an extendable guideway defining a forward end and an after end, the forward end adapted for positioning adjacent the one or more tubes;

b. at least one lance with a cleaning head thereon;

c. a self contained drive unit providing combined axial and rotational movement of the at least one lance, the drive unit including:

i. a stationary water duct to receive cleaning fluid from a source;

ii. a rotating water duct in sealed, rotating engagement with the stationary water duct; and iii. a swivel joint between the stationary and rotating water ducts with an inner geometry that does not present a flow resistance to the cleaning fluid;

d. retractable, interlocked support members within the guideway supporting the drive unit; and e. a support supporting the forward end of the guideway, the support defining a mechanism for horizontal and vertical movement of the guideway.

2. The machine of claim 1, wherein the drive unit is adapted to be removed from the guideway by backing it out of the guideway.

3. The machine of claim 1, wherein the guideway contains no powered components.

* * * * *